US010381141B2

(12) United States Patent
Nagata et al.

(10) Patent No.: US 10,381,141 B2
(45) Date of Patent: Aug. 13, 2019

(54) RARE EARTH MAGNET AND A METHOD FOR MANUFACTURING COMPACTABLE POWDER FOR THE RARE EARTH MAGNET WITHOUT JET MILLING

(71) Applicants: XIAMEN TUNGSTEN CO., LTD., Fujian (CN); Fujian Changing Golden Dragon Rare-Earth Co., Ltd., Fujian Province (CN)

(72) Inventors: Hiroshi Nagata, Fujian (CN); Chonghu Wu, Fujian (CN)

(73) Assignees: Xiamen Tungsten Co., Ltd., Xiamen, Fujian (CN); Fujian Changting Golden Dragon Rare-Earth Co., Ltd, Fujian Provice OT (CN)

( * ) Notice: Subject to any disclaimer, the term of this patent is extended or adjusted under 35 U.S.C. 154(b) by 502 days.

(21) Appl. No.: 14/441,961

(22) PCT Filed: Nov. 8, 2013

(86) PCT No.: PCT/CN2013/086807

§ 371 (c)(1),
(2) Date: May 11, 2015

(87) PCT Pub. No.: WO2014/071874

PCT Pub. Date: May 15, 2014

(65) Prior Publication Data

US 2015/0279530 A1 Oct. 1, 2015

(30) Foreign Application Priority Data

Nov. 9, 2012 (CN) ..... 2012 1 0452739

(51) Int. Cl.

| | |
|---|---|
| ***H01F 1/057*** | (2006.01) |
| ***C22C 38/00*** | (2006.01) |
| ***C22C 38/02*** | (2006.01) |
| ***C22C 38/04*** | (2006.01) |
| ***C22C 38/10*** | (2006.01) |
| ***C22C 38/16*** | (2006.01) |
| ***C22C 38/22*** | (2006.01) |
| ***C22C 38/32*** | (2006.01) |
| ***C22C 38/46*** | (2006.01) |
| ***C22C 38/54*** | (2006.01) |
| ***B22F 3/04*** | (2006.01) |
| ***B22F 3/12*** | (2006.01) |
| ***B22F 9/04*** | (2006.01) |

(Continued)

(52) U.S. Cl.

CPC ..... *H01F 1/0577* (2013.01); *B22F 3/04* (2013.01); *B22F 3/12* (2013.01); *B22F 9/04* (2013.01); *C22C 38/002* (2013.01); *C22C 38/005* (2013.01); *C22C 38/008* (2013.01); *C22C 38/02* (2013.01); *C22C 38/04* (2013.01); *C22C 38/10* (2013.01); *C22C 38/16* (2013.01); *C22C 38/22* (2013.01); *C22C 38/30* (2013.01); *C22C 38/32* (2013.01); *C22C 38/46* (2013.01); *C22C 38/54* (2013.01); *H01F 1/0556* (2013.01); *H01F 1/0557* (2013.01); *H01F 1/0573* (2013.01); *H01F 1/0576* (2013.01); *H01F 41/0266* (2013.01); *B22F 2009/043* (2013.01); *B22F 2009/048* (2013.01); *B22F 2999/00* (2013.01); *C22C 2202/02* (2013.01)

(58) Field of Classification Search

CPC ..... B22F 2009/048; B22F 2999/00; B22F 2201/013; B22F 2009/043; B22F 3/04; B22F 3/12; B22F 9/04; C22C 38/005; H01F 1/0556; H01F 1/0557; H01F 1/0573; H01F 1/0576; H01F 1/0577; H01F 41/0266

USPC ..... 148/101

See application file for complete search history.

(56) References Cited

U.S. PATENT DOCUMENTS 5,049,053 A * 9/1991 Tabaru ..... H01F 7/021 249/134
5,431,747 A * 7/1995 Takebuchi ..... C22C 33/02 148/302

(Continued)

FOREIGN PATENT DOCUMENTS

CN 1112720 * 11/1995
CN 1112720 A 11/1995

(Continued)

OTHER PUBLICATIONS

Suryanarayana, C. "Mechanical alloying and milling." 2001. 46. p. 1-184.*

*Primary Examiner* — Colleen P Dunn
*Assistant Examiner* — Nicholas A Wang
(74) *Attorney, Agent, or Firm* — Cooper Legal Group, LLC

(57) ABSTRACT

The present invention discloses manufacturing methods of a powder for compacting rare earth magnet powder and rare earth magnet that omit jet milling process, which comprises the steps as follows: 1) casting: casting the molten alloy of rare earth magnet raw material by strip casting method to obtain a quenched alloy with average thickness in a range of 0.2~0.4 mm; 2) hydrogen decrepitation: decrepitating the quenched alloy and a plurality of rigid balls into a rotating hydrogen decrepitation container simultaneously, the quenched alloy is crushed under a hydrogen pressure between 0.01~1 MPa, cooling the alloy and the balls, then screening the mixture to remove the rigid balls and obtain the powder. As the jet milling process is omitted, the oxygenation during the process of the jet milling may be avoided, therefore the process may be non-oxide, and the mass production of magnet with super high property may be possible.

20 Claims, No Drawings

(51) Int. Cl.

| | |
|---|---|
| ***C22C 38/30*** | (2006.01) |
| ***H01F 1/055*** | (2006.01) |
| ***H01F 41/02*** | (2006.01) |

(56) References Cited

U.S. PATENT DOCUMENTS 6,120,620 A * 9/2000 Benz ..... H01F 1/0577 148/101
7,258,751 B2 * 8/2007 Tomizawa ..... C22C 28/00 148/101
2004/0231751 A1 * 11/2004 Kuniyoshi ..... H01F 1/0557 148/105
2005/0028892 A1 * 2/2005 Sasaki ..... B22F 1/0007 148/302
2005/0081959 A1 4/2005 Kim et al.
2010/0034688 A1 * 2/2010 Nagata ..... B22F 3/02 419/32
2010/0148897 A1 * 6/2010 Nozawa ..... B22D 11/0611 335/302
2010/0230013 A1 * 9/2010 Nakajima ..... B22D 11/0611 148/538
2011/0241810 A1 * 10/2011 Horiuchi ..... C22C 1/0433 335/302
2011/0262297 A1 * 10/2011 Ishii ..... B22F 1/0014 419/23
2012/0021221 A1 * 1/2012 Miyoshi ..... B82Y 25/00 428/402
2015/0243433 A1 * 8/2015 Sun ..... B22F 9/04 148/102

FOREIGN PATENT DOCUMENTS

CN 1347123 A 5/2002
CN 1442258 * 9/2003
CN 1442258 A 9/2003
CN 101541999 A 9/2009
CN 101740190 A 6/2010
CN 102982936 A 3/2013
CN 103212710 * 7/2013

* cited by examiner

RARE EARTH MAGNET AND A METHOD FOR MANUFACTURING COMPACTABLE POWDER FOR THE RARE EARTH MAGNET WITHOUT JET MILLING

FIELD OF THE INVENTION

The present invention relates to magnet manufacturing technique field, especially to manufacturing methods of a powder for compacting rare earth magnet and the rare earth magnet that omit jet milling process.

BACKGROUND OF THE INVENTION

Rare earth magnet is based on intermetallic compound $R_2T_{14}B$, thereinto, R is rare earth element, T is iron or transition metal element replacing iron or part of iron, B is boron, Rare earth magnet is called the king of the magnet with excellent magnetic properties, the max magnetic energy product (BH)max is ten times higher than that of the ferrite magnet (Ferrite), besides, the rare earth magnet has good machining property, the operation temperature can reach 200° C., it has a hard quality, a stable performance, a high cost performance and a wide applicability.

There are two types of rare earth magnets depending on the manufacturing method: one is sintered magnet and the other one is bonded magnet. The sintered magnet has wider applications. In the conventional technique, the process of sintering the rare earth magnet is normally performed as follows: raw material preparing→melting→casting→hydrogen decrepitation (HD)→jet milling (JM)→compacting under a magnetic field→sintering→heat treatment→magnetic property evaluation→oxygen content evaluation of the sintered magnet.

Crushing method of rare earth magnet is usually applied with a two-stage crushing method: hydrogen decrepitation (HD) and jet milling (JM). Hydrogen decrepitation (HD) is a method that for the rare earth magnet alloy (for example NdFeB magnet alloy) to absorb hydrogen, with the absorption of hydrogen, the hydrogen absorption part of the alloy may expand so that the inner of the alloy breaks or cracks, that is a relatively simple grinding method. Jet milling (JM) is a method for ultrasonically accelerating the powder in almost no oxygen atmosphere, the powders impact mutually, then the impacted powder is classified as desirable powder and R rich ultra fine powder (below 1 μm). It is a common belief that jet milling is a necessary process, the reason is that, the powder with certain centralized particle size distribution may improve the compacting property, orientation, coercivity and other magnet properties.

Compared to other powder particles with less content of rare earth element R (with larger particle size), R rich ultra fine powder is oxygenated more easily, if sintering the green compacts without removing the R rich ultra fine powder, the rare earth element may be significantly oxygenated in the sintering process, resulting in low production of crystallization phase with main phase $R_2T_{14}B$ as rare earth element R is used to bind with oxygen. However, the process of removing ultra fine powder needs powder classifying device, special filter to recycle the inert gases and other complicated devices. The classifying process in jet milling methods needs a screen shape rotating blade with a high rotating speed, however, to ensure a stable rotating speed in 3000 rpm~5000 rpm, it may cause the consumption of the rotating blade, bearing and other precise components. Besides, the departed ultra fine powder of the rare earth magnet alloy may be easily reacted with oxygen and burn fiercely that brings danger to the operators when cleaning the jet milling device.

With the continuous development of low oxygenation technique in the rare earth magnet manufacturing and the continuous improvement of the air-tightness technique from the compacting to the sintering processes, oxygenation may rarely happens during from the compacting to the sintering processes. Therefore, oxygenation may mainly happen during the jet milling process that needs large amount of jet steam, for example, when the oxygen content in the jet milling is about 10000 ppm, the oxygen content of the obtained sintered magnet is about 2900 ppm~5300 ppm; however, for obtaining the sintered magnet with a lower oxygen content by decreasing the oxygen content of the jet steam, there may need to increase the investment cost and the manufacturing cost.

In addition, as rare earth resource is continuously reduced with continuous mining, rare earth is more and more precious, so that it has to efficiently use the rare earth. A loss of about 0.5~3% of the powder in the jet milling process may gradually become a problem.

SUMMARY OF THE INVENTION

One object of the present invention is to overcome the disadvantages of the conventional technology and to provide a manufacturing method of a powder for compacting rare earth magnet omitting jet milling process, which improves the manufacturing processes which are before the process of the jet milling for omitting the process of jet milling so as to prevent unavoidable oxidation in the jet milling process, thus acquiring a real non-oxidation process and the mass production of magnets with super high property becomes possible.

The technical proposal of the present invention to solve the technical problem is that:

A manufacturing method of a powder for compacting rare earth magnet omitting jet milling process, the rare earth magnet comprises $R_2T_{14}B$ main phase, R is selected from at least one rare earth element including yttrium, and T is selected from at least one transition metal element including Fe; the method comprising the steps of:

1) casting: casting the molten alloy of rare earth magnet raw material by strip casting method to get a quenched alloy with average thickness in a range of 0.2~0.4 mm;

2) hydrogen decrepitation: putting the quenched alloy and a plurality of rigid balls into a rotatable hydrogen decrepitation container simultaneously, rotating the container, the quenched alloy is crushed under a hydrogen pressure between 0.01~1 MPa, then screening the mixture to remove the rigid balls and obtain the powder.

It has to be noted that, the rigid balls will not break in the hydrogen decrepitation process.

The rare earth magnet of the present invention is sintered magnet.

In another preferred embodiment, in weight ratio, more than 95% of the quenched alloy has a thickness in a range of 0.1~0.7 mm.

In another preferred embodiment, it further comprises a process of screening the powder by a 300~1500 mesh screen.

In another preferred embodiment, it further comprises a powder dehydrogenation process.

In another preferred embodiment, the rotating rate of the hydrogen decrepitation container is in a range of 30 rpm~100 rpm.

In another preferred embodiment, the rigid balls are steel balls, metal Mo balls, metal W balls, stainless steel balls, tungsten carbide balls, aluminum oxide balls, zirconium oxide balls or silicon carbide balls with ball size in a range of ϕ0.5 mm~ϕ60 mm.

The rare earth magnet of the present invention further comprises, except necessary elements R, T, B to form the $R_2T_{14}B$ main phase, a doping element M with a proportion of 0.1 at %~10 at %, M is selected from at least one of the elements Al, Ga, Ca, Sr, Si, Sn, Ge, Ti, Bi, C, S or P.

In another preferred embodiment, the quenched alloy is obtained in a cooling rate between $10^{2\circ}$ C./s~$10^{4\circ}$ C./s and in an average cooling rate between $1*10^{3\circ}$ C./s~$8*10^{3\circ}$ C./s, the hydrogen decrepitation period of the quenched alloy is 1~24 hours, and the dehydrogenation period is 0.5~10 hours.

In another preferred embodiment, the hydrogen decrepitation process is performed after preheating the quenched alloy to a temperature of 150° C.~600° C.

In another preferred embodiment, in atomic percent, the component of the quenched alloy is $R_eT_fA_gJ_hG_iD_k$, R is Nd or comprising Nd and selected from at least one of the elements La, Ce, Pr, Sm, Gd, Dy, Tb, Ho, Er, Eu, Tm, Lu and Y; T is Fe or comprising Fe and selected from at least one of the elements Ru, Co and Ni; A is B or comprising B and selected from at least one of the elements C or P; J is selected from at least one of the elements Cu, Mn, Si and Cr; G is selected from at least one of the elements Al, Ga, Ag, Bi and Sn; D is selected from at least one of the elements Zr, Hf, V, Mo, W, Ti and Nb; and the subscripts are configured as:

$12 \le e \le 16$, $5 \le g \le 9$, $0.05 \le h \le 1$, $0.2 \le i \le 2.0$, k is $0 \le j \le 4$, $f = 100-e-g-h-i-k$.

It has to be noted that, as the elements O, N are impurities may be easily added during operation, the alloy powder may mix with a little regular amount of the elements O, N.

In another preferred embodiment, in the rare earth magnet raw material, the content of Co is below 1 at %.

In another preferred embodiment, the strip casting method can apply with existing known water cooling cant casting method, water cooling plain disk casting method, double roller method, single roller method or centrifugal casting method.

It has to be noted that, jet milling is omitted in the following processes. Instead, the powder after hydrogen decrepitation is added with corresponding organic additives according to the character of the powder, then the powder is formed in a magnetic field; as the formability of the powder obtained in the present invention is different from the conventional powders, it is better to choose a conventional simple mold for performing the two stage compacting method comprising magnetic field compacting and isostatic pressing (CIP), the compact is degreased and degassed in the vacuum, then the compact is sintered in vacuum or in inert gas in a temperature of 900° C.~1140° C., so the sintered magnet has an oxygen content below 1000 ppm, the reason is that, without the process of the jet milling, the probability of the powder's exposure to gas may be reduced, so that it may obtain magnet with low oxygen content and high properties.

In another preferred embodiment, the organic additive is selected from mineral oil, synthetic oil, animal and vegetable oil, organic esters, paraffin, polyethylene wax or modified paraffin, the weight ratio of the organic additive and the rare earth alloy magnetic powder is 0.01~1.5:100.

In another preferred embodiment, the organic ester is methyl caprylate. In the present invention, the methyl caprylate has very well lubrication effect, as it is easily volatized in high temperature, even the additive amount has 1.5% of the weight of the rare earth alloy magnetic powder, there would be little amount of elements C, O left in the sintered magnet, compared to ordinary additive, the methyl caprylate may not only have a better lubricant effect and improve the orientation of degree and formability effect, but also ensure the Br, Hcj and (BH)max of the sintered magnet from being influenced.

A second object of the present invention is to provide a manufacturing method of rare earth magnet omitting jet milling process.

A manufacturing method of rare earth magnet omitting jet milling process, the rare earth magnet comprises $R_2T_{14}B$ main phase, R is selected from at least one rare earth element including yttrium, and T is selected from at least one transition metal element including Fe; the method comprising the steps of:

casting the molten alloy of rare earth magnet raw material by strip casting method to obtain a quenched alloy with average thickness in a range of 0.2~0.4 mm; putting the quenched alloy and a plurality of rigid balls into a rotatable hydrogen decrepitation container simultaneously, rotating the container, the quenched alloy is crushed under a hydrogen pressure between 0.01~1 MPa, then screening the mixer to remove the rigid balls and obtain the powder;

compacting the powder in a two section compacting method comprising magnetic field compact and isostatic pressing compact to make a green compact; and sintering the green compact to make a permanent magnet.

Compared to the conventional technology, the present invention has following advantages:

1) The present invention omits the jet milling process and has the following advantages consequently: firstly it may be capable of saving the precious rare earth resource, secondly simplifying the manufacturing process, and thirdly performing a low cost manufacturing.

2) The method may obtain rare earth sintered magnet with oxygen content below 1000 ppm;

3) In the hydrogen decrepitation process, the quenched alloy with average thickness in a range of 0.2~0.4 mm made by the previous processes is used, the quenched alloy and a plurality of rigid balls are put into a rotating hydrogen decrepitation container simultaneously, then the alloy is crushed by hydrogen absorption under a hydrogen pressure between 0.01~1 MPa; by the impacting of the rigid balls, the alloy is ball milled in the container of the stainless steel rotating container of the hydrogen decrepitation furnace, therefore it increases the contact between the hydrogen and the alloy, and further decrepitation performs consequently, the powder is obtained by combining effects of hydrogen decrepitation and ball milling, then the powder is screened to obtained required powder.

Besides, when the ball miller rotates, with the friction of the rigid balls and the inner wall of the container, the rigid balls are forced upwardly in the rotating direction and then the balls drop down consequently, so the alloy strip is milled by the impacting of the dropping rigid balls and the milling work between the rigid balls and the inner wall of the container. The present invention applies an external force to the slightly adhesive quenched alloy by the impacting of the rigid balls, so as to make the alloy dispersed, thus improving the hydrogen decrepitation, comparing to the powder made by simply hydrogen decrepitation, the present invention can obtain more powder with low oxygen content.

4) As the jet milling process is omitted, the oxygenation during the process of the jet milling may be avoided, therefore the process may be non-oxide process, and the mass production of magnet with low oxygen content and super high property may be possible;

5) The present invention is configured as the ball milling is performed with the hydrogen absorption of the alloy, so that the new exposed surface of the alloy due to ball milling can fully absorb hydrogen, thus ensuring smooth performance of the hydrogen decrepitation.

6) In addition, comparing to the process of performing the ball milling process after the hydrogen decrepitation process, the present invention may not need transfer, which is capable of avoiding oxidation unavoidable during the transfer, further eliminating the possibility of detonation due to intense oxidation.

DETAILED DESCRIPTION OF THE EMBODIMENTS

The present invention will be further described with the embodiments.

Embodiment 1

In the raw material preparing process: Nd, Pr, Dy, Tb, Gd with 99.5% purity, industrial Fe—B, industrial pure Fe, Co with 99.99% purity and Cu, Al, Zr with 99.5% purity are prepared, counted in atomic percent, prepared in $R_eT_fA_gJ_hG_iD_k$ components.

The contents of the elements are shown in TABLE 1:

TABLE 1

| proportioning of each element | | | | | | | | | | | | | |
|---|---|---|---|---|---|---|---|---|---|---|---|---|---|
| R | | | | | T | | A | | J | | G | | D |
| Nd | Pr | Dy | Tb | Gd | Fe | Co | C | B | Mn | Cr | Ga | Sn | W |
| 8 | 2 | 1.5 | 1 | 1 | 79.1 | 0.4 | 0.1 | 6 | 0.2 | 0.2 | 0.2 | 0.2 | 0.1 |

Preparing 500 Kg raw material by weighing in accordance with TABLE 1.

In the melting process: the 500 Kg raw material is divided into 16 copes and respectively put into an aluminum oxide made crucible, an intermediate frequency vacuum induction melting furnace is used to melt the raw material in $10^2$ Pa vacuum below 1550° C.

In casting process: Ar gas is filled to the melting furnace so that the Ar pressure would reach 60000 Pa after the process of vacuum melting, then using following casting method respectively: the quenched alloy is obtained in a cooling rate of $10^{2\circ}$ C./s~$10^{4\circ}$ C./s with average cooling rate $1*10^{3\circ}$ C./s~$8*10^{3\circ}$ C./s, the casting manners and average strip thickness are shown in TABLE 2, therein, double-roller quenching method is used in TABLE 2, inclined surface disk casting method is used in TABLE 3.

The thickness of the quenched alloy depends on the rotating rate of the roller or the rotating rate of the inclined surface disk.

The strip thickness of the quenched alloy strip is measured by a micrometer and measured for 100 strips each time, and the strip thicknesses are recorded. When measuring, it has to be random sampled to measure the thickness, one strip is only once measured, the measured position is near to the geometric center of the alloy strip, and the strip can not be bended for measuring. The samples should be taken from upper layer, central layer and lower layer.

To avoid impurity and pollution, the staff should wear disposable grooves when measuring.

As can be seen from the measuring result, in weight ratio, the thicknesses of 95% of the quenched alloy of Embodiment 3, Embodiment 4, embodiment 5 and embodiment 11, embodiment 12, embodiment 13 are in a range of 0.1~0.7 mm.

In the hydrogen decrepitation process: the quenched alloy and a plurality of steel balls of ϕ10 mm~ϕ40 mm are put into a container of the hydrogen decrepitation furnace, then the container is pumped to be vacuum at room temperature, then filling with hydrogen with 99.999% purity so that the hydrogen pressure is configured to reach 0.03 Mpa, absorbing hydrogen for 2 hours, during the hydrogen absorption, the container rotates at a rotating rate of 60 rpm, at the same time, the quenched alloy is ball milled, then keeping vacuum in 600° C. for 2 hours, and then cooling the container and taking the powder out.

Taking the powder out, firstly the mixture is screened for separating the balls and the powder, then the powder is screened by a 500 mesh ultrasonic screen, the screened powder is then collected. The screened fine powder has a recovery rate of over 99.5%.

Methyl caprylate is added to the screened powder, the additive amount is 0.4% of the weight of the screened powder, the mixture is comprehensively blended by a V-type mixer for 1 hour.

In the compacting process under a magnetic field: a transversed type magnetic field molder is used, the powder with methyl caprylate is compacted in once to form a cube with sides of 40 mm in an orientation filed of 2.1 T and under a compacting pressure of 0.2 ton/cm$^2$, then the once-forming cube is demagnetized in a 0.2 T magnetic filed. The once-forming compact (green compact) is sealed so as not to expose to air, the compact is secondary compacted by a secondary compact machine (isostatic pressing compacting machine) under a pressure of 1.2 ton/cm$^2$.

In the examination of corner-breakage of the green compact: permanent magnet material is unqualified with even a little bit corner-breakage, by visual inspection, if there are broken, corner breakage or crack with a length of more than 1 mm, it may be determined as unqualified and the defective rate is counted.

In the sintering progress: the green compact is moved to a sintering furnace to sinter, in a vacuum of $10^{-3}$ and respectively maintained for 2 hours in 200° C. and for 2 hours in 900° C., then in Ar gas atmosphere and under 1000 Pa pressure, sintering for 2 hours in 1080° C., after that filling Ar gas into the sintering furnace so that the Ar pressure would reach 0.1 MPa, then cooling it to room temperature.

In the heating progress: the sintered magnet is heated for 1 hour in 450° C. in the atmosphere of high purity Ar gas, then cooling it to room temperature and taking it out.

In magnetic property evaluation process: the sintered magnet is tested by NIM-10000H type nondestructive testing system for BH large rare earth permanent magnet of China Jiliang University.

In the oxygen content of sintered magnet evaluation process: the oxygen content of the sintered magnet is measured by EMGA-620W type oxygen and nitrogen analyzer from HORIBA company of Japan.

The magnetic property evaluation results of the embodiments and the comparing samples are shown in TABLE 2 and TABLE 3:

TABLE 2

The magnetic property and oxygen content evaluation of the embodiments and the comparing samples.

| No. | | Average strip thickness (mm) | Defective rate of the compact (%) | Br (kGs) | Hcj(k0e) | SQ (%) | (BH)max (MG0e) | Oxygen content of the sintered magnet (ppm) |
|---|---|---|---|---|---|---|---|---|
| 1 | Comparing sample | 0.07 | 21 | 10.2 | 11.6 | 82.3 | 22.4 | 689 |
| 2 | Comparing sample | 0.1 | 1 | 11.2 | 35.1 | 98.2 | 31.2 | 276 |
| 3 | embodiment | 0.2 | 0 | 11.3 | 35.3 | 99.1 | 31.3 | 275 |
| 4 | embodiment | 0.3 | 0 | 11.2 | 35.2 | 99.1 | 31.2 | 269 |
| 5 | embodiment | 0.4 | 0 | 11.3 | 34.1 | 99.2 | 31.2 | 283 |
| 6 | Comparing sample | 0.5 | 1 | 11.3 | 34.8 | 98.5 | 31.1 | 265 |
| 7 | Comparing sample | 0.7 | 24 | 10.6 | 27.6 | 84.2 | 21.2 | 324 |
| 8 | Comparing sample | 1 | 67 | 10.2 | 24.3 | 78.6 | 18.5 | 478 |

TABLE 3

The magnetic property and oxygen content evaluation of the embodiments and the comparing samples.

| No. | | Average strip thickness (mm) | Defective rate of the compact (%) | Br (kGs) | Hcj(k0e) | SQ (%) | (BH)max (MG0e) | Oxygen content of the sintered magnet (ppm) |
|---|---|---|---|---|---|---|---|---|
| 9 | Comparing sample | 0.05 | 29 | 12.6 | 26.7 | 77.3 | 25.3 | 923 |
| 10 | Comparing sample | 0.1 | 1 | 11.2 | 35.6 | 98.1 | 31.2 | 282 |
| 11 | embodiment | 0.2 | 0 | 11.3 | 35.8 | 99 | 31.2 | 275 |
| 12 | embodiment | 0.3 | 0 | 11.3 | 35.6 | 99 | 31.3 | 270 |
| 13 | embodiment | 0.4 | 0 | 11.3 | 35.6 | 99 | 31.3 | 275 |
| 14 | Comparing sample | 0.5 | 1 | 11.2 | 35.5 | 98.3 | 31 | 271 |
| 15 | Comparing sample | 0.7 | 23 | 10.2 | 28.6 | 85.5 | 22.3 | 578 |
| 16 | Comparing sample | 10 | 67 | 9.8 | 27.5 | 79.2 | 19.8 | 768 |

As can be seen from the embodiments and the comparing samples, the steel balls are put into the rotating container, the process of ball milling works along with the process of hydrogen decrepitation consequently, therefore further improving the powder crushing effect of the hydrogen decrepitation with the process of ball milling as a further process of milling is introduced.

The steel balls can be generally placed in the container of the stainless steel rotating hydrogen decrepitation furnace and need not to be taken out.

As can be seen from above embodiment, the quenched alloy has best condition of thickness. As a relatively thinner strip of raw material has more amorphous phase and isometric crystal, which may result in bad orientation degree, reducing of the contents of Br, (BH)max; in addition, due to the easily oxygenated ultra fine powder, the oxygen content may increase, and the properties of coercivity and squareness may be worse consequently. As a relatively thicker strip of raw material has more α-Fe and $R_2Fe_{17}$ phase, large amount of Nd rich phase may lead to bad orientation degree and reducing of the contents of Br, (BH)max, besides, due to the easily oxygenated Nd rich phase, the oxygen content may increase, and the properties of coercivity and squareness may be worse consequently.

Besides, the present invention is capable of controlling the average cooling rate of the molten alloy to obtain a strip casting with evenly crystals and reducing the number of oversize crystals and undersize crystals, so that even omitting jet milling process, it can obtain desirable powder for compacting.

Embodiment 2

In the raw material preparing process: Nd, Ho, Y with 99.9% purity; industrial Fe—B, Fe—P, Fe—Cr; industrial pure Fe; Ni, Si with 99.9% purity and Bi, V with 99.5% purity are prepared, counted in atomic percent, and prepared in $R_eT_fA_gJ_hG_iD_k$ components.

The contents of the elements are shown in TABLE 4:

TABLE 4

| proportioning of each element | | | | | | | | | | |
|---|---|---|---|---|---|---|---|---|---|---|
| R | | | T | | A | | J | | G | D |
| Nd | Ho | Y | Fe | Ni | B | P | Cr | Si | Bi | V |
| 11 | 2 | 0.5 | 78.7 | 0.3 | 6.55 | 0.05 | 0.2 | 0.1 | 0.3 | 0.3 |

Preparing 16 copies of 100 Kg raw material by weighing in accordance with TABLE 4.

In the melting process: 100 Kg of the prepared raw material is put into an aluminum oxide made crucible, an intermediate frequency vacuum induction melting furnace is used to melt the raw material in $10^{-3}$ Pa vacuum in 1600° C.

In casting process: Ar gas is filled to the melting furnace so that the Ar pressure would reach to 40000 Pa after vacuum melting, then on a water cooling casting plain disk, the material is casted to the quenched alloy in a cooling rate of $10^{2\circ}$ C./s~$10^{4\circ}$ C./s with average cooling rate of $1*10^{3\circ}$ C./s~$8*10^{3\circ}$ C./s.

The thickness of the quenched alloy depends on the rotating rate of the water-cooling casting plain disk.

The strip thickness of the quenched alloy strip is measured by a micrometer and measured for 100 strips each time, and the strip thicknesses are recorded. When measuring, it has to be random sampled to measure the thickness, one strip is only once measured, the measured position is near to the geometric center of the alloy strip, the strip can not be bended for measuring. The samples should be taken from upper layer, central layer and lower layer.

To avoid impurity and pollution, the staff should wear disposable grooves when measuring.

As can be seen from the measuring result, the average thickness of the quenched alloy is 0.25 mm, in weight ratio, 98% of the quenched alloy has the thickness in a range of 0.1~0.7 mm.

In the hydrogen decrepitation process: each copy of the quenched alloy with serial numbers 1~7 and a plurality of tungsten carbide balls of 40 g and ϕ5 mm~ϕ60 mm are put into a container of a stainless steel rotating hydrogen decrepitation furnace, the inner diameter of the container is ϕ1000 mm, then the container is pumped to be vacuum, then respectively filling with hydrogen of 99.99% purity and so that the hydrogen pressures are configured to respectively reach the pressures of serial numbers 1~7, absorbing hydrogen for 0.5 hour, pumping the furnace to be vacuum in 650° C. for 2 hours, during the hydrogen absorption and pumping processes, the stainless steel rotating container rotates at a rotating rate of 30 rpm, and the processes of hydrogen decrepitiaon and ball milling are performed simultaneously, and then cooling the container and taking the powder out. The mixture is screened by a 5 mesh screen for separating the balls and the powder, then the powder is milled by a disk miller and then screened by a 500 mesh ultrasonic screen, the screened powder is then collected. The screened fine powder has a recovery rate of over 99.7%.

And in another experiment, each copy of the quenched alloy with serial numbers 8~16 and a plurality of tungsten carbide balls of 20 g and ϕ3 mm~ϕ20 mm are put into the stainless steel container of the hydrogen decrepitation furnace with inner diameter ϕ600 mm, the container is pumped to be vacuum, then respectively be adjusted to reach the temperatures of No. 8~16, filling the hydrogen gas of 99.999% purity and so that the hydrogen pressure would reach 0.3 MPa, absorbing hydrogen absorption for 10 hours, and pumping the furnace to be vacuum in 650° C. for 2 hours, during the processes of hydrogen absorption and pumping, the stainless steel rotating container rotates at a rotating rate of 100 rpm, the processes of hydrogen decrepitiaon and ball milling are performed simultaneously, and then cooling the container and taking the powder out. The mixture is screened by a 5 mesh screen for separating the balls and the powder, then the powder is milled by a disk miller and then screened by a 800 mesh ultrasonic screen, the screened powder is then collected. The screened fine powder has a recovery rate of over 99.7%.

Methyl caprylate is added to the screened powder, the additive amount is 0.2% of the weight of the screened powder, the mixture is comprehensively blended by a V-type mixer for 1 hour.

In the compacting process under a magnetic field: a transversed type magnetic field molder is used, the powder with methyl caprylate is compacted in once to form a cube with sides of 25 mm in an orientation filed of 1.8 T and under a compacting pressure of 0.2 ton/$cm^2$, then the once-forming cube is demagnetized in a 0.2 T magnetic filed. The once-forming compact (green compact) is sealed so as not to expose to air, the compact is secondary compacted by a secondary compact machine (isostatic pressing compacting machine) under a pressure of 1.2 ton/$cm^2$.

In the examination of corner-breakage of the green compact: permanent magnet material is unqualified with even a little bit corner-breakage, by visual inspection, if there are broken, corner breakage or crack with a length of more than 1 mm, it may be determined as unqualified and the defective rate is counted.

In the sintering progress: the green compact is moved to the sintering furnace to sinter, in a vacuum of $10^{-1}$ Pa and respectively maintained for 2 hours in 200° C. and for 2 hours in 900° C., then sintering for 4 hours in 980° C., after that filling Ar gas into the sintering furnace so that the Ar pressure would reach 0.1 MPa, then cooling it to room temperature.

In the heating progress: the sintered magnet is heated for 1 hour in 650° C. in the atmosphere of high purity Ar gas, then cooling it to room temperature and taking it out.

In magnetic property evaluation process: the sintered magnet is tested by NIM-10000H type nondestructive testing system for BH large rare earth permanent magnet from China Jiliang University.

In the oxygen content of sintered magnet evaluation process: the oxygen content of the sintered magnet is measured by EMGA-620W type oxygen and nitrogen analyzer from HORIBA company of Japan.

The magnetic property and oxygen content evaluation of the embodiments and the comparing samples in different pressures are shown in TABLE 5, the magnetic property and oxygen content evaluation of the embodiments in different preheating temperature of the quenched alloy are shown in TABLE 6.

TABLE 5

The magnetic property and oxygen content evaluation of the embodiments and the comparing samples in different pressures.

| No. | | Hydrogen pressure (atm) | Defective rate of the compact (%) | Br (kGs) | Hcj(k0e) | SQ(%) | (BH)max (MG0e) | Oxygen content of the sintered magnet (ppm) |
|---|---|---|---|---|---|---|---|---|
| 1 | comparing sample | 0.08 | 56 | 12.3 | 19.2 | 86.6 | 32.5 | 421 |
| 2 | embodiment | 0.1 | 1 | 13 | 26.4 | 98.4 | 41.2 | 278 |
| 3 | embodiment | 0.6 | 0 | 13.1 | 26.5 | 99.2 | 41.3 | 276 |
| 4 | embodiment | 1.5 | 0 | 13.2 | 26.7 | 99.1 | 41.2 | 289 |
| 5 | embodiment | 6 | 0 | 13.1 | 26.3 | 99.1 | 41.1 | 282 |
| 6 | embodiment | 10 | 1 | 13.1 | 26.4 | 98.3 | 40.8 | 267 |
| 7 | comparing sample | 15 | 23 | 12.2 | 19.8 | 75.1 | 23.8 | 398 |

TABLE 6

The magnetic property and oxygen content evaluation of the embodiments in different preheating temperature of the quenched alloy.

| No. | | Preheat temperature ( ) | Defective rate of the compact (%) | Br(kGs) | Hcj(k0e) | SQ(%) | (BH)max (MG0e) | Oxygen content of the sintered magnet (ppm) |
|---|---|---|---|---|---|---|---|---|
| 8 | embodiment | 25 | 2 | 13 | 26.1 | 96.7 | 41.4 | 324 |
| 9 | embodiment | 100 | 1 | 13.1 | 26.3 | 98.2 | 41.6 | 356 |
| 10 | embodiment | 150 | 0 | 13.2 | 27.2 | 99.1 | 42.2 | 253 |
| 11 | embodiment | 200 | 0 | 13.3 | 27.1 | 99.1 | 42.3 | 243 |
| 12 | embodiment | 250 | 0 | 13.3 | 27.4 | 99.1 | 42.3 | 212 |
| 13 | embodiment | 350 | 0 | 13.3 | 27.3 | 99 | 42.1 | 209 |
| 14 | embodiment | 450 | 0 | 13.3 | 27.1 | 98.2 | 42.1 | 162 |
| 15 | embodiment | 600 | 1 | 13.2 | 26.7 | 95.5 | 41.7 | 329 |
| 16 | embodiment | 650 | 2 | 13.1 | 26.3 | 94.5 | 41.6 | 397 |

As can be seen from above, the present invention has the most appropriate decrepitation pressure in the hydrogen decrepitation process. In low pressure, the alloy can not fully absorb hydrogen, so that it can not be fully crushed. And if the hydrogen pressure is too high, there are safety risks, there may not only has safety risks, but also can not be fully crushed, the reason is that if the main phase and Nd rich absorb hydrogen at the same time, the decrepitation may be difficult, and also results in high defective rate.

As can be seen from this embodiment, the present invention also discloses a proper preheating temperature range for the quenched alloy at the beginning of the hydrogen decrepitation, however, with the increasing of the initial temperature, the hydrogen amount mixed to the main phase may decrease consequently, and crack may happen along the Nd rich phase, furthermore, if the temperature reaches 600° C., the hydrogen absorbed by the Nd rich phase may decrease, thus may not acquire a comprehensive decrepitation.

Same as the Embodiment 1, this embodiment is capable of controlling the average cooling rate of the molten alloy to obtain strips with evenly crystals and less oversize crystals and undersize crystals, so that even omitting jet milling process, it can make required powder for compacting.

Embodiment 3

In the raw material preparing process: Nd, Pr, Dy with 99.9% purity; industrial Fe—B, C; industrial pure Fe; Cu, Sn, Hf, Co with 99.9% purity are prepared, in atomic percent, prepared in $R_eT_fA_gJ_hG_iD_k$ components.

The contents of the elements are shown in TABLE 7:

TABLE 7 proportioning of each element

| | R | | | T | | A | | J | G | D |
|---|---|---|---|---|---|---|---|---|---|---|
| No. | Nd | Pr | Dy | Fe | Co | B | C | Cu | Sn | Hf |
| 1 | 12 | 3 | 0.6 | 75.9 | 0 | 6 | 0.25 | 0.05 | 0.2 | 2 |
| 2 | 12 | 3 | 0.6 | 75.5 | 0.4 | 6 | 0.25 | 0.05 | 0.2 | 2 |
| 3 | 12 | 3 | 0.6 | 74.9 | 1 | 6 | 0.25 | 0.05 | 0.2 | 2 |
| 4 | 12 | 3 | 0.6 | 74.5 | 1.4 | 6 | 0.25 | 0.05 | 0.2 | 2 |
| 5 | 12 | 3 | 0.6 | 73.9 | 2 | 6 | 0.25 | 0.05 | 0.2 | 2 |

According to above 5 serial numbers, each serial number is prepared with 100 Kg raw material by respectively weighing.

In the melting process: 100 Kg of the prepared raw material according to the serial number is put into an magnesium oxide made crucible respectively, an intermediate frequency vacuum induction melting furnace is used to melt the raw materials in 1 Pa vacuum below 1600° C.

In casting process: Ar gas is filled to the melting furnace to 65000 Pa after vacuum melting, then a centrifugal casting device is used, the material is casted to the quenched alloy in a cooling rate of $10^{2}$° C./s~$10^{4}$° C./s with average cooling rate of $1*10^{3}$° C./s~$8*10^{3}$° C./s.

The thickness of the quenched alloy depends on the rotating rate of the centrifugal casting device.

The strip thickness of the quenched alloy strip is measured by a micrometer and for measured for 100 strips each time, and the strip thicknesses are recorded. When measuring, it has to be random sampled to measure the thickness, one strip is only once measured, the measured position is near to the geometric center of the alloy strip, the strip can not be bended for measuring. The samples should be taken from upper layer, central layer and lower layer.

To avoid impurity and pollution, the staff should wear disposable grooves when measuring.

As can be seen from the measuring result, the average thickness of the quenched alloy is 0.4 mm, in weight ratio, 95% of the quenched alloy has the thickness in a range of 0.1~0.7 mm.

In the hydrogen decrepitation process: the quenched alloy with average thickness of 0.4 mm and a plurality of stainless steel balls of 10 g and ϕ20 mm~ϕ40 mm are put into a container of the hydrogen decrepitation furnace with inner diameter of ϕ1000 mm, then the container is pumped to be vacuum and heated to 200° C. under a pressure of $10^{-2}$ Pa, then filling hydrogen with 99.999% purity into the container so that the pressure would reach 0.1 Mpa, absorbing hydrogen for 0.2 hour, and pumping to be vacuum for 0.5 hour in 550° C., during the processes of the hydrogen absorption and vacuum pumping, the container rotates at a rotating rate of 100 rpm, at the same time, the quenched alloy is ball milled and cooled afterward, then taking the powder out. After taking the powder out, firstly the mixture is screened by a 3 mesh screen for separating the balls and the powder, then the powder is screened by a 300 mesh ultrasonic screen after passing through a continuous mortar type grinder, the screened powder is then collected. The screened fine powder has a recovery rate of over 99.95%.

Methyl caprylate is added to the screened powder, the additive amount is 0.2% of the weight of the screened powder, the mixture is comprehensively blended by a V-type mixer for 1 hour.

In pressing under magnetic field process: a traversed type magnetic field molder is used, the powder with methyl caprylate is compacted in once to form a cube with sides of 25 mm in an orientation filed of 2.2 T and under a compacting pressure of 0.3 ton/$cm^2$, then the once-forming cube is demagnetized in a magnetic filed of 0.15 T. The once-forming compact (green compact) is sealed so as not to expose to air, the compact is secondary compacted by a secondary compact machine (isostatic pressing compacting machine) under a pressure of 1.0 ton/$cm^2$.

In the examination of corner-breakage of the green compact: permanent magnet material is unqualified with even a little bit corner-breakage, by visual inspection, if there are broken, corner breakage or crack with a length of more than 1 mm, it may be determined as unqualified and the defective rate is counted.

In the sintering progress: the green compact is moved to a sintering furnace to sinter, in a vacuum of $10^{-2}$ Pa and respectively maintained for 2 hours in 150° C., for 2 hours in 650° C. and for 2 hours in 800° C., then sintering for 4 hours in 1080° C., after that filling Ar gas into the sintering furnace so that the Ar pressure would reach 10000 Pa, then cooling it to room temperature.

In the heating progress: the sintered magnet is heated for 1 hour in 540° C. in the atmosphere of high purity Ar gas, then taking it out after cooling it to room temperature.

In magnetic property evaluation process: the sintered magnet is tested by NIM-10000H type nondestructive testing system for BH large rare earth permanent magnet of China Jiliang University.

In the oxygen content of sintered magnet evaluation process: the oxygen content of the sintered magnet is measured by EMGA-620W type oxygen and nitrogen analyzer from HORIBA company of Japan.

The magnetic property evaluation results of the embodiments are shown in TABLE 8:

TABLE 8

The magnetic property and oxygen content evaluation of the embodiments.

| No. | | Additive amount of Co (at %) | Defective rate of the compact (%) | Br(kGs) | Hcj(k0e) | SQ(%) | (BH)max (MG0e) | Oxygen content of the sintered magnet (ppm) |
|---|---|---|---|---|---|---|---|---|
| 1 | Embodiment | 0 | 0 | 13.1 | 18.3 | 99.4 | 42.2 | 245 |
| 2 | Embodiment | 0.4 | 0 | 13 | 18.1 | 98.4 | 42.1 | 258 |
| 3 | Embodiment | 1 | 1 | 12.9 | 18.2 | 98.1 | 42 | 265 |
| 4 | Embodiment | 1.4 | 2 | 12.7 | 17.3 | 95.7 | 40.9 | 276 |
| 5 | Embodiment | 2 | 4 | 12.5 | 17.1 | 94.3 | 36.8 | 285 |

As can be seen from above embodiments and comparing samples, the crushing method of the present invention has most appropriate additive amount of Co, if the additive amount of Co is too much, it may result in bad crushing effect and increasing of defective rate. Based on investigation of the powder by X-ray diffraction, with the increasing of the additive amount of Co, $R_2Co_2$ and $R_2Co_3$ crystal can be observed, it can be noted that, metallic compound with Co doesn't absorb hydrogen, thus resulting in bad crushing and formability effects.

Same as the Embodiment 1, this embodiment is capable of controlling the average cooling rate of the molten alloy to obtain a strip casting with evenly crystals and reducing the number of oversize crystals and undersize crystals, so that even omitting jet milling process, it can obtain desirable powder for compacting.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A method of manufacturing a compactable powder for a rare earth magnet without jet milling, the rare earth magnet comprising a $R_2T_{14}B$ main phase, where R is at least one rare earth element including yttrium, and T is at least one transition metal element including Fe, wherein the method comprises the steps of:

casting a molten alloy of a rare earth magnet raw material by strip casting and cooling to obtain a quenched alloy with an average thickness ranging from 0.2~0.4 mm;

putting the quenched alloy and a plurality of rigid balls into a rotatable hydrogen decrepitation container;

hydrogen decrepitating and simultaneously ball milling by rotating the rotatable hydrogen decrepitation container to crush the quenched alloy under a hydrogen pressure ranging between 0.01 to 1 MPa and to produce a mixture;

dehydrogenating and simultaneously ball milling by rotating the rotatable hydrogen decrepitation container to crush the mixture and produce the compactable powder;

screening the compactable powder from the plurality of rigid balls to remove the plurality of rigid balls; and passing the compactable powder through a 300~1500 mesh screen without further pulverization of the compactable powder after dehydrogenating and simultaneously ball milling, wherein the plurality of rigid balls does not break during rotating the rotatable hydrogen decrepitation container.

2. The method according to claim 1, wherein more than 95 weight % of the quenched alloy has a thickness ranging from 0.1~0.7 mm.

3. The method according to claim 1, wherein the rotatable hydrogen decrepitation container has a rotation rate that ranges from 30 rpm~100 rpm.

4. The method according to claim 1, wherein cooling to obtain the quenched alloy is accomplished at a cooling rate ranging between $10^{2\circ}$ C./s~$10^{4\circ}$ C./s and an average cooling rate ranging between $1*10^{3\circ}$ C./s~$8*10^{3\circ}$ C./s, wherein hydrogen decrepitating takes place for a hydrogen decrepitation period ranging from 1~24 hours, and wherein dehydrogenating the compactable powder takes place for a dehydrogenation period ranging from 0.5~10 hours.

5. The method according to claim 1, wherein the plurality of rigid balls are rigid balls selected from the group consisting of steel balls, metal Mo balls, metal W balls, stainless steel balls, tungsten carbide balls, aluminum oxide balls, zirconium oxide balls or silicon carbide balls, and have a ball size ranging from 0.5 mm~60 mm.

6. The method according to claim 1, wherein the method further comprises, prior to hydrogen decrepitating, preheating the quenched alloy to a temperature ranging from 150° C.~350° C.

7. The method according to claim 1, wherein the quenched alloy is expressed, in atomic percent, as:

$$R_eT_fA_gJ_hG_iD_k,$$

where R is Nd or comprises Nd and at least one of La, Ce, Pr, Sm, Gd, Dy, Tb, Ho, Er, Eu, Tm, Lu or Y;

where T is Fe or comprises Fe and at least one of Ru, Co or Ni;

where A is B or comprises B and at least one of C or P;

where J is at least one of Cu, Mn, Si or Cr;

where G is at least one of Al, Ga, Ag, Bi or Sn;

where D is at least one of Zr, Hf, V, Mo, W, Ti or Nb; and where subscripts e, f, g, h, i and k are configured as:

$12 \le e \le 16$, $5 \le g \le 9$, $0.05 \le h \le 1$, $0.2 \le i \le 2.0$, k is $0 \le k \le 4$, and $f = 100-e-g-h-i-k$.

8. The method according to claim 1, wherein the rare earth magnet raw material has a proportion of Co that is below 1 at %.

9. The method of claim 1, wherein the method further comprises, prior to hydrogen decrepitating, preheating the quenched alloy to a temperature ranging from 150° C.~250° C.

10. A method of manufacturing a rare earth magnet without jet milling, the rare earth magnet comprising a $R_2T_{14}B$ main phase, where R is at least one rare earth element including yttrium, and T is at least one transition metal element including Fe, wherein the method comprises the steps of:

casting a molten alloy of a rare earth magnet raw material by strip casting to obtain a quenched alloy having an average thickness ranging from 0.2~0.4 mm;

putting the quenched alloy and a plurality of rigid balls into a rotatable hydrogen decrepitation container;

rotating the rotatable hydrogen decrepitation container to hydrogen decrepitate and simultaneously ball milling to crush the quenched alloy under a hydrogen pressure ranging between 0.01 to 1 MPa and produce a mixture;

dehydrogenating and simultaneously ball milling by rotating the rotatable hydrogen decrepitation container to crush the mixture and produce compactable powder;

screening the compactable powder from the plurality of rigid balls to remove the plurality of rigid balls;

compacting, after screening and without further pulverization of the compactable powder after dehydrogenating and simultaneously ball milling, the compactable powder in a two-part compacting method comprising magnetic field compacting and isostatic pressing compacting to provide a green compact; and sintering the green compact to provide the rare earth magnet, wherein the rare earth magnet is a permanent magnet, wherein the plurality of rigid balls does not break during rotating the rotatable hydrogen decrepitation container.

11. The method of claim 10, wherein the method further comprises adding an organic additive to the compactable powder prior to compacting the compactable powder.

12. The method of claim 11, wherein a weight ratio of the organic additive to the compactable powder ranges from 0.01:100~1.5:100.

13. The method of claim 11, wherein the organic additive is methyl caprylate.

14. The method of claim 10, wherein the two-part compacting method comprises demagnetizing the compactable powder between magnetic field compacting and isostatic pressing compacting.

15. The method of claim 14, wherein the two-part compacting method comprises sealing, so as to not expose to air, the compactable powder between magnetic field compacting and isostatic pressing compacting.

16. The method of claim 10, wherein the two-part compacting method comprises sealing, so as to not expose to air, the compactable powder between magnetic field compacting and isostatic pressing compacting.

17. The method of claim 10, wherein magnetic field compacting forms a cube in an orientation field of 2.1 T.

18. The method of claim 10, wherein the method further comprises heating the rare earth magnet in an atmosphere of Ar gas after sintering the green compact.

19. The method of claim 10, wherein an oxygen content of the rare earth magnet after the sintering is less than 1000 ppm.

20. The method of claim 10, wherein an oxygen content of the rare earth magnet after the sintering is less than 450 ppm.

* * * * *